US010429127B2

(12) United States Patent
Alyanak et al.

(10) Patent No.: US 10,429,127 B2
(45) Date of Patent: Oct. 1, 2019

(54) HOME APPLIANCE DEVICE

(71) Applicant: BSH HAUSGERAETE GMBH, Munich (DE)

(72) Inventors: Altan Alyanak, Istanbul (TR); Lars Dinter, Munich (DE); Fidan Gueler, Istanbul (TR); Emre Guentav, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 128 days.

(21) Appl. No.: 15/697,863

(22) Filed: Sep. 7, 2017

(65) Prior Publication Data

US 2018/0080707 A1 Mar. 22, 2018

(30) Foreign Application Priority Data

Sep. 19, 2016 (TR) ..... a 2016/13011

(51) Int. Cl.

| | |
|---|---|
| ***F25B 21/02*** | (2006.01) |
| ***F25D 31/00*** | (2006.01) |
| ***A47G 23/02*** | (2006.01) |
| ***F25D 25/02*** | (2006.01) |

(52) U.S. Cl.

CPC ..... *F25D 31/007* (2013.01); *A47G 23/02* (2013.01); *F25D 25/024* (2013.01); *F25D 2303/0841* (2013.01); *F25D 2303/0843* (2013.01); *F25D 2331/803* (2013.01); *F25D 2331/809* (2013.01); *F25D 2500/02* (2013.01)

(58) Field of Classification Search

CPC ..... A47F 5/0043; A47F 23/02; F25D 25/02; F25D 23/028; F25D 31/007; F25D 25/024; F25D 2303/0841; F25D 2303/0843; F25D 2331/803; F25D 231/809; F25D 2500/02

USPC ..... 62/3.6

See application file for complete search history.

(56) References Cited

U.S. PATENT DOCUMENTS

| | | | | |
|---|---|---|---|---|
| 5,404,935 A * | 4/1995 | Liebermann | A21B 1/10 165/48.1 |
| 2010/0307186 A1* | 12/2010 | Kwon | F25D 23/028 62/407 |
| 2012/0104924 A1* | 5/2012 | Nash | F25D 25/02 312/408 |
| 2014/0091696 A1* | 4/2014 | Welker | A47F 5/0043 312/408 |

* cited by examiner

*Primary Examiner* — Davis D Hwu

(74) *Attorney, Agent, or Firm* — Laurence A. Greenberg; Werner H. Stemer; Ralph E. Locher

(57) ABSTRACT

For the purpose of improving a stability a home appliance device, in particular a home appliance chiller device, at least one elongate frame element which has at least one first fixing feature and at least one deposit element for depositing of victuals are provided. The deposit element has at least one second fixing feature in an end region and is connected to the frame element. The first fixing feature and the second fixing feature being fixed to each other in a form-fit manner in order to prevent a movement of the deposit element with respect to the frame element in a direction which is at least substantially parallel to a main extension direction of the frame element.

13 Claims, 3 Drawing Sheets

HOME APPLIANCE DEVICE

CROSS-REFERENCE TO RELATED APPLICATION

This application claims the benefit, under 35 U.S.C. § 119, of Turkish patent application TR 2016/13011, filed Sep. 19, 2016; the prior application is herewith incorporated by reference in its entirety.

BACKGROUND OF THE INVENTION

Field of the Invention

The invention relates to a home appliance device, in particular a home appliance chiller device, and to a method for manufacturing a home appliance device.

Wine coolers are known which contain a bottle holder. The bottle holder has an elongate frame element and deposit elements, which are screwed to the elongate frame element.

SUMMARY OF THE INVENTION

The objective of the invention is, in particular, to provide a generic home appliance device with improved characteristics regarding stability and/or assembly. The objective is achieved, according to the invention, by the features of the main apparatus claim and the main method, while advantageous implementations and further developments of the invention may be gathered from the dependent claims.

A home appliance device, in particular a home appliance chiller device, is proposed, containing at least one elongate frame element which has at least one first fixing feature and at least one deposit element for depositing victuals which has at least one second fixing feature in an end region and is connected to the frame element. The first fixing feature and the second fixing feature being connected to each other in a form-fit manner in order to prevent a movement of the deposit element with respect to the frame element in a direction which is at least substantially parallel to a main extension direction of the frame element.

By means of the invention in particular a stability of the home appliance device can be improved. Furthermore, in particular an assembly can be facilitated. It is further achievable that in particular the deposit element and the frame element self-align via the first and second fixing features. Advantageously, the frame element and the deposit element can be connected in a simple manner, wherein in particular additional connecting parts such as screws can be avoided.

In this context, "configured" is in particular to mean specifically designed and/or equipped. By an object being configured for a certain function is in particular to be understood that the object implements and/or fulfills the certain function in at least one application state and/or operating state. By a "home appliance device" is in particular to be understood at least a portion, preferably a subassembly group, of a home appliance. The home appliance is in particular provided for storing and preferably tempering victuals such as beverages, in particular alcoholic beverages such as wine, meat, fish, vegetables, fruits, milk and/or dairy products in at least one operating state, advantageously for the purpose of enhancing a quality and/or a keepability of the stored victuals. Advantageously, the home appliance is embodied as a home chiller appliance, which is in at least one operating state configured for cooling victuals. The home chiller appliance could in particular be embodied as a climate cabinet, an ice-box, a refrigerator, a freezer and/or a refrigerator-freezer combination. Advantageously, the home chiller appliance is embodied as a wine cooler. However, the home appliance could also be embodied as a home appliance for warming up and in particular for cooking victuals, e.g. an oven, a steamer and/or a microwave. The home appliance device may in particular further has an inner liner and in particular an insert, which is preferably movably coupled to the inner liner. In this context, the term "a first object and a second object being movably coupled" is in particular to mean that the first object and the second object are at least indirectly attached, connected and/or fixed to each other and are movable with respect to each other preferably in at least one direction, advantageously in precisely one direction.

The insert is in particular configured for storage of victuals. The insert contains in particular a shelf and a frame. The shelf is formed at least partly by the deposit element. The frame is formed at least partly by the frame element. Advantageously, the shelf is implemented as a bottle holder. In this context a "bottle holder" is in particular to be understood as shelf which is configured for depositing bottles. The shelf is in particular at least partly shaped corresponding to a contour and/or a profile of a bottle. The shelf is in particular mounted by the frame, which is preferably configured for coupling, in particular indirectly coupling, the shelf to the inner liner. In this context, "coupling" is in particular to mean at least indirectly or preferably directly attaching, fixing and/or connecting.

The deposit element is in particular an elongate element and is preferably implemented as a slat and/or a rod. In this context an "elongate object" is in particular to be understood as an object having a main extension which is at least twice, preferably at least five times and advantageously at least ten times larger than any other extension of the object, in particular than any other extension of the object which is oriented at least substantially perpendicular to the main extension of the object. A "main extension" of an object is, in particular, to be understood, in this context, as a longest side of an imaginary rectangular cuboid which only just entirely encloses the object. In this context "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°. Preferably the deposit element is at least partly made of wood. The home appliance device contains in particular at least two, preferably at least three and advantageously a plurality of deposit elements, wherein in particular at least two, preferably neighboring, deposit elements, which are in particular arranged offset to each other in a direction which is at least substantially perpendicular to a main extension direction of the deposit element, are together configured for storage of at least one bottle and are preferably in direct contact with the bottle. A "main extension direction" of an object is, in particular, to be understood, in this context, as a direction which is parallel to a longest side of an imaginary rectangular cuboid which only just entirely encloses the object. In this context "at least substantially perpendicular" is in particular to be understood as an orientation of a direction with respect to a reference direction, in particular n a plane, wherein the direction and the reference direction include an angle of 90°, the orientation in particular having a deviation of less than 15°, advantageously of less than 10° and particularly advantageously of less than 2°. The deposit element, preferably the deposit elements, forms/form the shelf of the insert in particular at least partly, preferably at least mostly and advantageously entirely. The term "at least mostly" with reference to an object is in particular to mean by more than 50%, preferably more than 70%, and advantageously more than 90% of a volume, in particular an enclosed volume, and/or of a mass of the object. The deposit element may contain two second fixing features in opposite end regions. In this context an "end region of an object" is in particular to be understood as a region which is connected to a free end of the object and which has an extension in the direction of the main extension direction of the object corresponding to at most 15%, preferably at most 10% and advantageously at most 5% of the main extension of the object.

The frame element is in particular configured for coupling the shelf of the insert to the inner liner. The frame element in particular mounts the deposit element and preferably arranges the deposit elements in juxtaposition to each other. The home appliance device contains in particular at least two frame elements, which are preferably arranged at least substantially parallel, preferably opposite and advantageously mirror-symmetrical to one another. The frame element may contain at least two, preferably at least three and advantageously a plurality of first fixing features, which are in particular arranged side-by-side, in particular alongside the main extension direction of the frame element. Preferably the number of first fixing features is equal to the number of deposit elements. The home appliance device may in particular comprise at least one further frame element and preferably at least two further frame elements. The further frame element in particular connects at least two frame elements to one another. The further frame element differs from the frame element at least substantially by the fact that the further frame element is free of the first fixing feature. The further frame element is in particular arranged at least substantially perpendicular to the frame element. The two further frame elements are preferably arranged at least substantially parallel, preferably opposite and advantageously mirror-symmetrical to one another. The frame element and/or the further frame element, preferably the frame elements and/or the further frame elements, form the frame of the insert in particular at least partly, preferably at least mostly and advantageously entirely.

The frame element and the deposit element first are in particular aligned via the first fixing feature and the second fixing feature, preferably in one plane. The first fixing feature and the second fixing feature in particular connect in a form-fit manner and possibly additionally in a force-fit manner. Additionally a fixation may be provided by a substance-to-substance bond, preferably an adhesive and/or cohesive connection. Preferably the first fixing feature and the second fixing feature form a plug-socket connection. The first fixing feature is in particular a socket of the plug-socket connection and is preferably at least partly implemented integrally with the frame element. The second fixing feature is in particular a plug of the plug-socket connection and is preferably at least partly implemented integrally with the deposit element. In this context, the term "a first object being at least partly implemented integrally with a second object" is in particular to mean that at least one component of the first object and at least one component of the second object are implemented integrally with each other. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. Advantageously, "implemented integrally" could in particular mean made of one piece. "Made of one piece" is, in particular, to mean, in this context, manufactured from one single piece, e.g. by production from one single cast and/or by manufacturing in a one-component or multi-component injection-molding process, and advantageously from a single blank.

It is also proposed that the first fixing feature and the second fixing feature are connected to each other in a form-fit manner in order to prevent a movement of the deposit element with respect to the frame element in a direction which is at least substantially perpendicular to a main extension direction of the frame element. Preferably the connection of the first fixing feature and the second fixing feature prevents a movement of the deposit element with respect to the frame in any direction which is at least substantially perpendicular to a main extension direction of the deposit element. As a result, in particular a stability of the home appliance device can be further improved.

In a preferred implementation of the invention it is proposed that the first fixing feature is implemented as a recess of the frame element and that the frame element contains at least one frame wall, which has at least two frame wall sections delimiting the recess at least partly in a direction which is at least substantially parallel to the main extension direction of the frame element and in particular in a direction which is at least substantially perpendicular to the main extension direction of the frame element and advantageously in any direction which is at least substantially perpendicular to a main extension direction of the deposit element. As a result, in particular the first fixing feature can be implemented in a simple manner. Advantageously, further separate components for fixing the frame element and the deposit element can be avoided.

In an advantageous implementation of the invention it is proposed that the deposit element comprises at least one circumferential deposit wall section, which embodies the second fixing feature. The deposit wall section is in particular a lateral wall section of the deposit element by which victuals, in particular bottles, can be positioned onto the deposit element. As a result, in particular the second fixing feature can be implemented in a simple manner. Advantageously, further separate components for fixing the frame element and the deposit element can be avoided.

In addition it is proposed that the first fixing feature contains a first circumference and the second fixing feature contains a second circumference the length of which is greater than the length of the first circumference and is by at most 20%, in particular at most 10% and preferably at most 5% greater than the length of the first circumference. In particular, respective contours and/or profiles of the first circumference and the second circumference are shaped correspondingly. As a result, a perfect fit of the first fixing feature and the second fixing feature can be achieved, while in particular production and or manufacturing tolerances can be compensated.

In particular, the first fixing feature and the second fixing feature comprise at least a two-fold, preferably at least a three-fold and advantageously a multiple rotation symmetry and preferably have the same symmetry axis. For the purpose of aligning the first fixing feature and the second fixing feature with one another independently from a rotary orientation, it is also proposed that the first fixing feature and the second fixing feature are at least substantially circular-shaped in at least one view, in particular viewed in a direction at least substantially parallel to the main extension direction of the deposit element. In this context, an "at least substantially circular-shaped object" is in particular to be understood as an object the shape of which differs by at most 20%, preferably by at most 10% and advantageously by at most 5% from a circular-shaped object.

In order to prevent a rotation of the deposit element with respect to the frame element, it is proposed that the frame element contains at least one first securing element and that the deposit element contains at least one second securing element at the end region, which connects to the first securing element in a form-fit manner. Preferably the first securing element and the second securing element form a tongue-and-groove connection. The first securing element is in particular a tongue of the tongue-and-groove connection and is preferably at least partly implemented integrally with the frame element. The second securing element is in particular a groove of the tongue-and-groove connection and is preferably at least partly implemented integrally with the deposit element. The deposit element may comprise two second securing elements in opposite end regions. The frame element may comprise at least two, preferably at least three and advantageously a plurality of first securing elements, which are in particular arranged side-by-side, in particular alongside the main extension direction of the frame element. Preferably the number of first securing elements of the frame element is equal to the number of deposit elements. Advantageously, the frame element contains only one first securing element, which is in particular configured to connect with a plurality of second securing elements and which extends preferably at least substantially parallel alongside the frame wall.

In particular, the first securing element and the second securing element contain at least a two-fold and preferably precisely a two-fold rotation symmetry. It is proposed that the second securing element is advantageously implemented as a rotation-securing recess, into which the first securing element engages at least partly, preferably at least mostly and advantageously entirely. The rotation-securing recess prevents in particular a rotation of the frame element with respect to the deposit element, wherein the rotation axis is at least substantially parallel to the main extension direction of the frame element. The rotation-securing recess is in particular manufactured as a cut-out of the preferably wooden deposit element. As a result, in particular a self-alignment of the first and second securing elements can be achieved.

Further it is proposed that the deposit element contains at least two at least substantially opposite wall sections which at least partly form the rotation-securing recess. In particular towards a free end of the end region, the two opposite wall sections diverge with respect to each other. The two opposite wall sections are in particular mirror-symmetrical with respect to the main extension direction of the deposit element. The first securing element contacts in particular at least the two opposite wall sections. As a result, a form-fit and/or force-fit connection of the first and second securing elements can be improved.

For the purpose of achieving strong friction between the opposite wall sections and the first securing elements, it is proposed that two opposite wall sections include in particular an angle of at least 0°, preferably at least 15° and advantageously at least 30°, and/or in particular less than 90°, preferably less than 75°, and advantageously less than 60°.

In a preferred implementation of the invention it is proposed that the rotation-securing recess is shaped at least substantially trapezoidal in at least one view, in particular viewed at least substantially perpendicular to a main extension direction of the deposit element. The deposit element comprises at least one further wall section, which is oriented at least substantially perpendicular to the main extension direction of the deposit element. In particular, the further wall section and at least one, preferably both, of the two opposite wall sections include an angle of at least 90°, preferably at least 105°, and advantageously at least 120°, and/or in particular less than 180°, preferably less than 165° and advantageously less than 150°. As a result, a form-fit and/or force-fit connection of the first and second securing elements can be further improved.

In an advantageous implementation of the invention it is proposed that the frame element contains at least one hollow profile which defines a receiving region, inside which the first securing element is at least partly arranged. Preferably the end region of the deposit element is arranged at least partly, in particular at least mostly and advantageously entirely inside the receiving region. The hollow profile is in particular at least partly, preferably at least mostly, and advantageously entirely embodied by the frame wall. In particular viewed at least substantially parallel to the main extension direction of the frame element the hollow profile has in particular a cross-section which is at least substantially rectangular. As a result, an appearance of the home appliance device can be improved as the securing elements can be hidden inside the frame element.

It is further proposed that the first securing element has an at least substantially circular-shaped and preferably annulus-shaped cross-section, which is in particular at least partly open, in at least one view, in particular viewed in a direction at feast substantially parallel to the main extension direction of the deposit element. The cross-section is open by at most 50%, preferably by at most 40% and advantageously by at most 30%. The first securing element contains in particular a hole, preferably in a direction of the main extension direction of the frame element. The hole may in particular be threaded such that the further frame element may be connected to the frame element by the bolt and/or screw connection, wherein the hole of the first securing element holds the screw and/or the bolt in place. Furthermore the hole may be used for clamping the first securing element inside the second securing element, in particular by spreading the first securing element with a preferably widening bolt and or screw. As a result, a stability of the first securing element can be improved.

Further, a method for manufacturing a home appliance device is proposed, wherein the home appliance device comprises at least one elongate frame element and at least one deposit element for depositing victuals; the method containing a method step of connecting the deposit element to the frame element by moving the deposit element with respect to the frame element in a direction at least substantially parallel to a main extension direction of the deposit element. In particular, the deposit element is at least partly plugged into the frame element, wherein in particular the fixing features align the frame element and the deposit element with respect to each other and preferably the securing elements prevent a rotation of the frame element and the deposit element with respect to each other. As a result, in particular a stability of the home appliance device can be improved. Furthermore, in particular an assembly of the home appliance device can be simplified.

Herein the home appliance device is not to be limited to the application and implementation described above. In particular, for the purpose of fulfilling a functionality herein described, the home appliance device may contain a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

Other features which are considered as characteristic for the invention are set forth in the appended claims.

Although the invention is illustrated and described herein as embodied in a home appliance device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
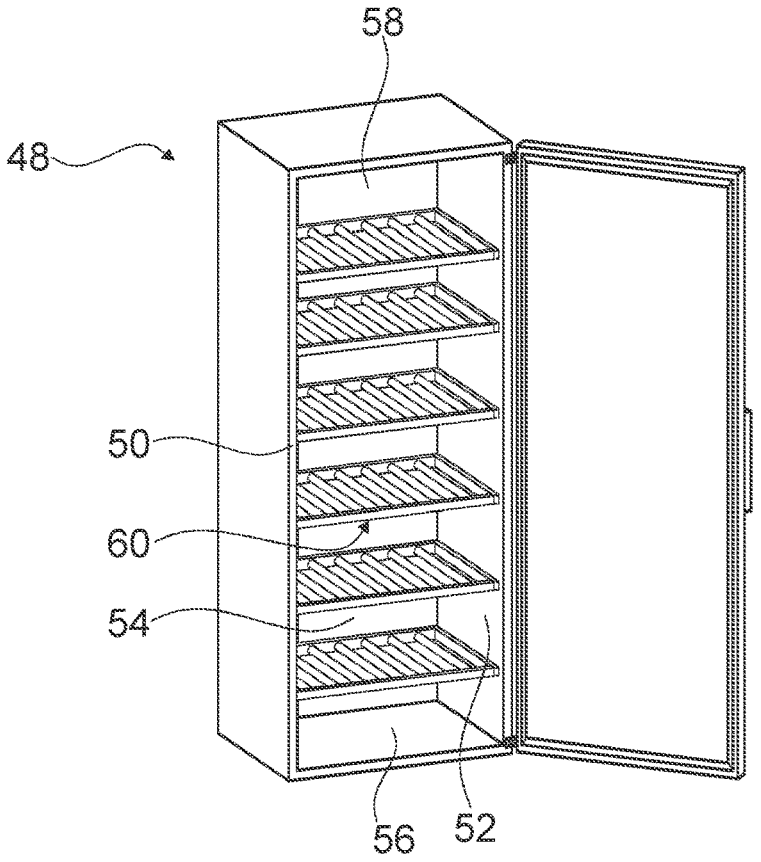
FIG. 1 is a diagrammatic, perspective view of a home appliance containing a home appliance device according to the invention.

Referring now to the figures of the drawings in detail and first, particularly to FIG. 1 thereof, there is shown a home appliance 48 containing a home appliance device, in a schematic perspective view. The home appliance 48 is embodied as a wine cooler. The home appliance 48 could further be embodied as a refrigerator, a climate cabinet, an ice-box, a freezer and/or a refrigerator-freezer combination. The home appliance device contains an inner liner 50. The inner liner 50 defines a storage space. The inner liner 50 contains walls 52, 54, 56, 58, which delimit the storage space. The inner liner 50 has two lateral walls 52, which are preferably arranged opposite each other. The inner liner 50 has a rear wall 54. The inner liner 50 has a bottom wall 56. The inner liner 36 has a top wall 58, which is preferably arranged opposite the bottom wall 56.

The home appliance device contains at least one insert 60. In the present case the home appliance device has six inserts 60. It is conceivable that the home appliance device may contain a deviating number of inserts 60 as deemed advantageous by someone skilled in the art. The insert 60 is embodied as a bottle holder. The home appliance device may preferably comprise a combination of different embodiments of inserts. For the sake of clarity, in the following only one insert 60 is given a reference numeral and is described in detail. The following description may be transferred to further inserts accordingly.

The insert 60 is movably coupled to the inner liner 50. The home appliance device has a non-illustrated guiding unit. The guiding unit couples the insert 60 to the inner liner 50. The guiding unit is configured for extraction and/or contraction of the insert 60 out of and/or into the inner liner 50.

Figure 2:
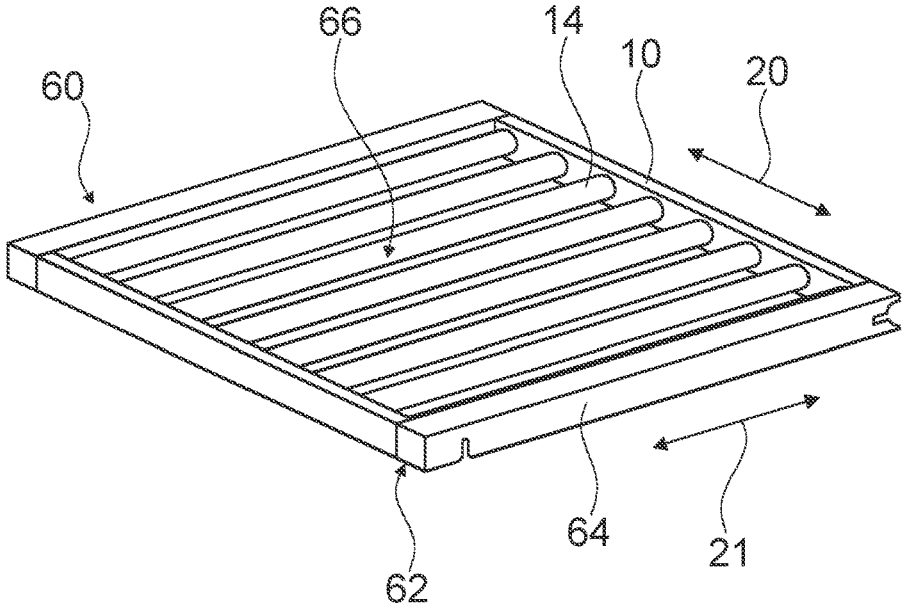
FIG. 2 is a perspective view of a portion of the home appliance device, containing an insert.

FIG. 2 shows a portion of the home appliance device with the insert 60, in a perspective view. The insert 60 contains a frame 62. The frame 62 contains at least one elongate frame element 10. In this case the frame 62 contains two elongate frame elements 10. The frame elements 10 are arranged at least substantially parallel, preferably opposite and advantageously mirror-symmetrical to one another. The frame elements 10 are arranged offset to each other in a direction which is at least substantially perpendicular to a main extension direction 20 of the frame elements 10. The frame 62 contains at least one further frame element 64. The further frame element 64 connects the frame elements 10 to each other. In the present case the frame 62 contains two further frame elements 64. The further frame elements 64 are arranged at least substantially parallel to each another. The further frame elements 64 are arranged offset to each other in a direction at least substantially perpendicular to a main extension direction of the further frame elements 64. The further frame elements 64 are arranged at least substantially perpendicular to the frame elements 10. For the sake of clarity, in the following only one frame element and in particular only one further frame element is given a reference numeral and is described in detail. The following description may be transferred to further inserts accordingly. The frame elements 10, 64 are at least partly made of metal. Alternatively or additionally the frame elements 10, 64 could be made of wood.

The insert 60 has a shelf 66. The shelf 66 is implemented as a bottle holder. The shelf 66 is at least partly shaped corresponding to a contour and/or a profile of a bottle. The shelf 66 contains at least one deposit element 14. The deposit element 14 is configured for depositing bottles. In the present case the shelf 66 has seven such deposit elements 14. The deposit elements 14 are arranged offset to each other in a direction at least substantially perpendicular to a main extension direction 21 of the deposit elements 14. For the sake of clarity, in the following only one deposit element is given a reference numeral and is described in detail. The following description may be transferred to further inserts accordingly. The deposit element 14 is connected to the frame element 10. In this case the deposit element 14 is implemented as a rod. Alternatively or additionally the deposit element 14 could be implemented as a slat. The deposit element 14 is made of wood.

Figure 3:
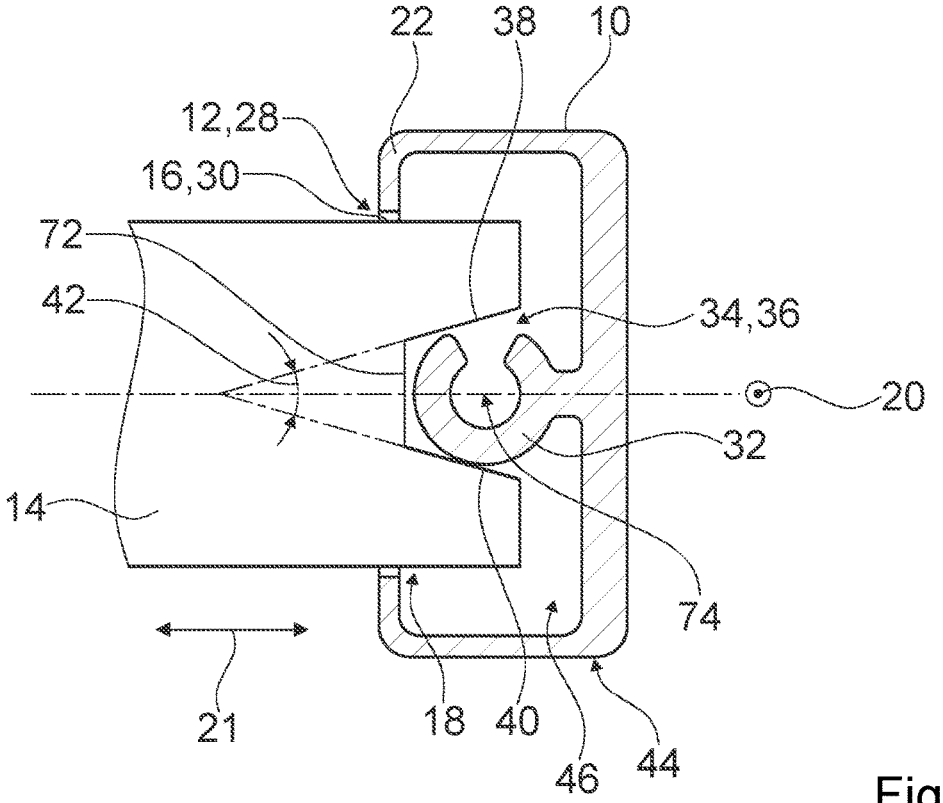
FIG. 3 is a cross-sectional view of a portion of the home appliance device, with a frame element and a deposit element.
Figure 4:
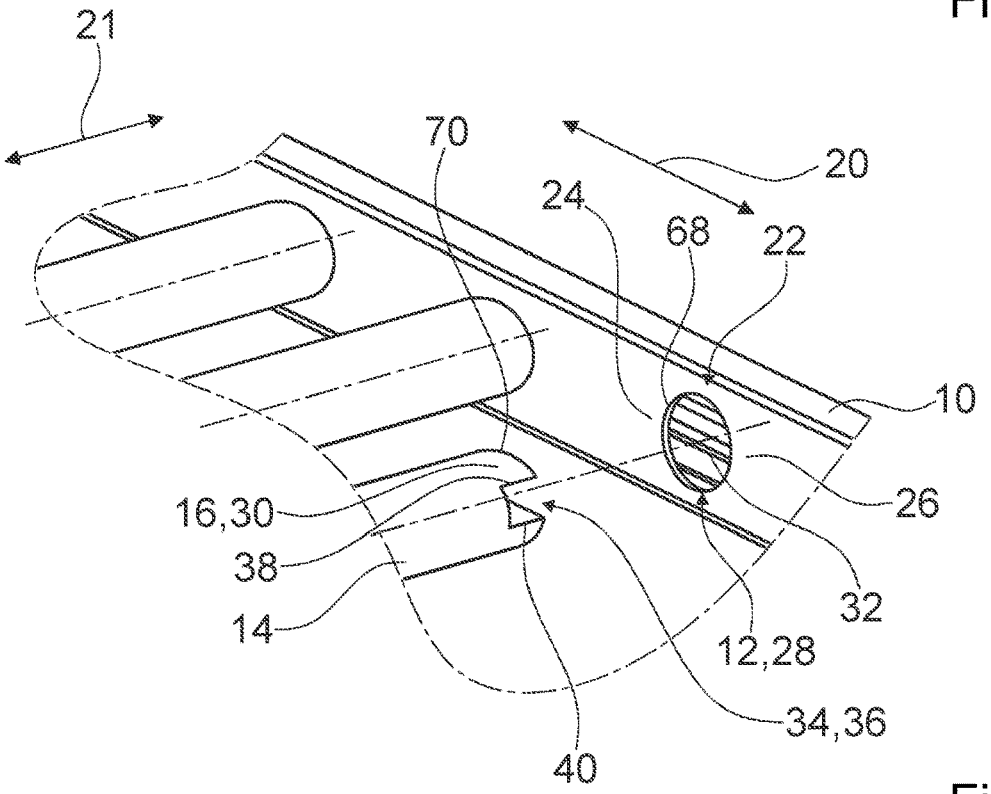
FIG. 4 is a perspective view of a portion of the home appliance device, with the frame element and the deposit element.

FIGS. 3-4 show a portion of the home appliance device, with at least one frame element 10 and at least one deposit element 14. The frame element 10 and the deposit element 14 are connected by a first fixing feature 12 of the frame element 10 and a second fixing feature 16 of the deposit element 14. The connection of the first fixing feature 12 and the second fixing feature 16 prevents movement of the deposit element 14 with respect to the frame element 10, in particular in any direction which is at least substantially perpendicular to a main extension direction 21 of the deposit element 14.

The frame element 10 contains the first fixing feature 12. The first fixing feature 12 is implemented integrally with the frame element 10. Preferably the number of first fixing features is equal to the number of deposit elements 14. The deposit element 14 contains at least one second fixing feature 16 in an end region 18. The second fixing feature 16 is implemented integrally with the deposit element 14. The deposit element 14 has two second fixing features 16 in opposite end regions 18. The first fixing feature 12 and the second fixing feature 16 are connected to each other in a form-fit manner in order to prevent a movement of the deposit element 14 with respect to the frame element 10 in a direction which is at least substantially parallel to a main extension direction 20 of the frame element 10. Further, the first fixing feature 12 and the second fixing feature 16 are connected to each other in a form-fit manner in order to prevent a movement of the deposit element 14 with respect to the frame element 10 in a direction which is at least substantially perpendicular to a main extension direction 20 of the frame element 10. The first fixing feature 12 and the second fixing feature 16 form a plug-socket-connection. The first fixing feature 12 is a socket of the plug-socket connection. The second fixing feature 16 is in particular a plug of the plug-socket connection.

The first fixing feature 12 is implemented as a recess 28 of the frame element 10. The frame element 10 contains at least one frame wall 22. The frame wall 22 has at least two frame wall sections 24, 26. The frame wall sections 24, 26 delimit the recess 28 at least partly in a direction which is at least substantially parallel to the main extension direction 20 of the frame element 10, in particular in any direction which is at least substantially perpendicular to a main extension direction 21 of the deposit element 14.

The deposit element 14 contains at least one circumferential deposit wall section 30. The deposit wall section 30 is a lateral wall section of the deposit element 14. On the deposit wall section 30 victuals, in particular bottles, can be deposited. The circumferential deposit wall section 30 forms the second fixing feature 16. The deposit element 14 contains the end region 18. The second fixing feature 16 is arranged in the end region 18.

Viewed in a direction at least substantially parallel to the main extension direction 21 of the deposit element 14, the first fixing feature 12 is at least substantially circular-shaped. Further, viewed in a direction at least substantially perpendicular to the main extension direction 20 of the frame element 10, the second fixing feature 16 is at least substantially circular-shaped. The first fixing feature 12 contains a first circumference 68. The second fixing feature 16 has a second circumference 70. A length of the first circumference 68 is greater than a length of the second circumference 70. The length of the first circumference 68 is greater than the length of the second circumference 70 by at most 20%.

The frame element 10 contains at least one first securing element 32. The first securing element 32 is implemented integrally with the frame element 10. The deposit element 14 contains at least one second securing element 34. The deposit element 14 contains the second securing element 34 at the end region 18. The deposit element 14 contains two second securing elements 34 in opposite end regions 18. The second securing element 34 is implemented integrally with the deposit element 14. In order to prevent a rotation of the deposit element 14 with respect to the frame element 10, the second securing element 34 connects with the first securing element 32 in a form-fit manner. The second securing element 34 is in particular a groove of the tongue-and-groove connection. The first securing element 32 and the second securing element 34 form the tongue-and-groove connection. The first securing element 32 is in particular a tongue of the tongue-and-groove connection.

The second securing element 34 is implemented as a rotation-securing recess 36. The first element 32 engages at least mostly into the second securing element 34. Viewed in a direction at least substantially perpendicular to the main extension direction 21 of the deposit element 14, the rotation-securing recess 36 is shaped at least substantially trapezoidal in at least one view. The deposit element 14 contains at least two at least substantially opposite wall sections 38, 40, which at least partly form the rotation-securing recess 36. The two opposite wall sections 38, 40 include an acute angle 42 of at least 30° and/or less than 60°. Towards a free end of the end region 18, the two opposite wall section 38, 40 diverge with respect to each other. The two opposite wall sections 38, 40 are arranged mirror-symmetrically with respect to the main extension direction 21 of the deposit element 14. The two wall sections 38, 40 are contacted by the first securing element 32 when the first securing element 32 engages into the second securing element 34. The deposit element 14 comprises at least one further wall section 72. The further wall section 72 is oriented at least substantially perpendicular to the main extension direction 21 of the deposit element 14. The further wall section 72 and at least one, preferably both, of the two opposite wall sections 38, 40 include an angle of at least 120° and/or less than 150°.

The frame element 10 contains at least one hollow profile 44. The hollow profile defines a receiving region 46. The first securing element 32 is at least partly arranged inside the receiving region 46. The hollow profile 44 is in particular at least partly, preferably at least mostly, and advantageously entirely embodied by the frame wall 22. Viewed at least substantially parallel to the main extension direction 20 of the frame element 10, the hollow profile 44 has in particular a cross-section which is at least substantially rectangular.

Viewed in a direction at least substantially parallel to the main extension direction 21 of the deposit element 14, the first securing element 36 has an at least substantially circular-shaped cross-section. The cross-section is annulus-shaped. The cross-section is at least partly open by at most 30%. The first securing element 32 contains a hole 74, which is preferably oriented in a direction of the main extension 20 of the frame element 10. The hole 74 may be threaded. The further frame element 64 may be connected to the frame element 10 by means of the bolt and/or screw connection. The hole 74 of the first securing element 32 holds the screw and/or the bolt in place. Furthermore the hole 74 may be used for clamping the first securing element 32 inside the second securing element 34, in particular by spreading the first securing element 32 with a preferably widening screw and/or bolt.

Figure 5:
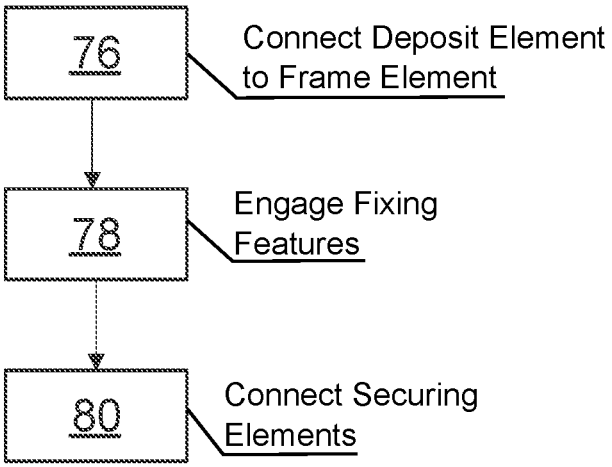
FIG. 5 is a flow chart of a method for manufacturing the home appliance.

FIG. 5 shows a method for manufacturing the home appliance device. In a method step 76 the deposit element 14 is connected to the frame element 10 by moving the deposit element 14 with respect to the frame element 10 in a direction at least substantially parallel to a main extension direction 21 of the deposit element 14. The deposit element 14 is at least partly plugged into the frame element 10. In a method step 78 the fixing features 12, 16 align the frame element 10 and the deposit element 14 with respect to each other. In a method step 80 the securing elements 32, 34 connect and preferably prevent a rotation of the frame element 10 and the deposit element 14 with respect to each other.

The following is a summary list of reference numerals and the corresponding structure used in the above description of the invention:

10 frame element
12 first fixing feature
14 deposit element
16 second fixing feature
18 end region
20 main extension direction (frame element)
21 main extension direction (deposit element)
22 frame wall
24 wall section
26 wall section
28 recess
30 deposit wall section
32 first securing element
34 second securing element
36 rotation-securing recess
38 wall section
40 wall section
42 acute angle
44 hollow profile
46 receiving region
48 home appliance
50 inner liner
52 wall
54 wall
56 wall
58 wall
60 insert
62 frame
64 further frame element
66 shelf
68 circumference
70 circumference
72 further wall section
74 hole
76 method step
78 method step
80 method step

The invention claimed is:

1. A home appliance device, comprising:

at least one elongate frame element having at least one first fixing feature; and at least one deposit element for depositing victuals and having an end region with at least one second fixing feature, said deposit element connected to said elongate frame element, said first fixing feature and said second fixing feature being fixed to each other in a form-fit manner in order to prevent a movement of said deposit element with respect to said elongate frame element in a direction being at least substantially parallel to a main extension direction of said elongate frame element, said first fixing feature and said second fixing feature being at least substantially circular-shaped in at least one view.

2. The home appliance device according to claim 1, wherein said first fixing feature and said second fixing feature being connected to each other in the form-fit manner in order to prevent a movement of said deposit element with respect to said elongate frame element in a direction which is at least substantially perpendicular to the main extension direction of said elongate frame element.

3. A home appliance device, comprising:

at least one elongate frame element having at least one first fixing feature; and at least one deposit element for depositing victuals and having an end region with at least one second fixing feature, said deposit element connected to said elongate frame element, said first fixing feature and said second fixing feature being fixed to each other in a form-fit manner in order to prevent a movement of said deposit element with respect to said elongate frame element in a direction being at least substantially parallel to a main extension direction of said elongate frame element;

said first fixing feature being implemented as a recess formed in said elongate frame element and said elongate frame element containing at least one frame wall having at least two frame wall sections delimiting said recess at least partly in the direction which is at least substantially parallel to the main extension direction of said elongate frame element.

4. A home appliance device, comprising:

at least one elongate frame element having at least one first fixing feature; and at least one deposit element for depositing victuals and having an end region with at least one second fixing feature, said deposit element having at least one circumferential deposit wall section embodying said second fixing feature, said deposit element being connected to said elongate frame element, said first fixing feature and said second fixing feature being fixed to each other in a form-fit manner in order to prevent a movement of said deposit element with respect to said elongate frame element in a direction being at least substantially parallel to a main extension direction of said elongate frame element.

5. A home appliance device, comprising:

at least one elongate frame element having at least one first fixing feature; and at least one deposit element for depositing victuals and having an end region with at least one second fixing feature, said deposit element being connected to said elongate frame element, said first fixing feature and said second fixing feature being fixed to each other in a form-fit manner in order to prevent a movement of said deposit element with respect to said elongate frame element in a direction being at least substantially parallel to a main extension direction of said elongate frame element;

said first fixing feature having a first circumference and said second fixing feature having a second circumference, said first circumference having a length being greater than a length of said second circumference and being by at most 20% longer than said second circumference.

6. A home appliance device, comprising:

at least one elongate frame element having at least one first fixing feature, said elongate frame element having at least one first securing element; and at least one deposit element for depositing victuals and having an end region with at least one second fixing feature, said deposit element being connected to said elongate frame element, said first fixing feature and said second fixing feature being fixed to each other in a form-fit manner in order to prevent a movement of said deposit element with respect to said elongate frame element in a direction being at least substantially parallel to a main extension direction of said elongate frame element;

said deposit element having at least one second securing element at said end region, said second securing element connecting in a form-fit manner to said first securing element for preventing a rotation of said deposit element with respect to said elongate frame element.

7. The home appliance device according to claim 6, wherein said second securing element being implemented as a rotation-securing recess, into which said first securing element at least partly engages.

8. The home appliance device according to claim 7, wherein said deposit element has at least two at least substantially opposite wall sections, which at least partly form said rotation-securing recess.

9. The home appliance device according to claim 8, wherein said two opposite wall sections have an acute angle of less than 90°.

10. The home appliance device according to claim 7, wherein said rotation-securing recess being shaped at least substantially trapezoidal in at least one view.

11. The home appliance device according to claim 6, wherein said elongate frame element has at least one hollow profile, which defines a receiving region inside which said first securing element is disposed at least partly.

12. The home appliance device according to claim 6, wherein said first securing element has an at least substantially circular-shaped cross-section in at least one view.

13. The home appliance device according to claim 1, wherein the home appliance device is a home appliance chiller device.

* * * * *